US009435072B1

(12) United States Patent
Harrison

(10) Patent No.: US 9,435,072 B1
(45) Date of Patent: Sep. 6, 2016

(54) APPAREL FASTENER ASSEMBLY

(71) Applicant: Howard S. Harrison, Miami, FL (US)

(72) Inventor: Howard S. Harrison, Miami, FL (US)

( * ) Notice: Subject to any disclaimer, the term of this patent is extended or adjusted under 35 U.S.C. 154(b) by 748 days.

(21) Appl. No.: 13/744,046

(22) Filed: Jan. 17, 2013

(51) Int. Cl.
*A41H 37/04* (2006.01)
*B25C 5/16* (2006.01)
*D06F 95/00* (2006.01)

(52) U.S. Cl.
CPC ..... *D06F 95/008* (2013.01)

(58) Field of Classification Search
CPC .. B65C 7/005; B65C 2201/00; A41H 37/04; B25C 5/16
USPC ..... 227/18, 67, 31, 37
See application file for complete search history.

(56) References Cited

U.S. PATENT DOCUMENTS

| | | | | |
|---|---|---|---|---|
| 3,774,267 | A | | 11/1973 | Sneider |
| 4,506,670 | A | * | 3/1985 | Crossley ..... 227/181.1 |
| D367,744 | S | | 3/1996 | White |
| 5,826,775 | A | | 10/1998 | Mooney et al. |
| 5,944,236 | A | | 8/1999 | Cinque |
| 6,389,657 | B1 | | 5/2002 | Turner |
| D521,368 | S | | 5/2006 | Carl |
| 7,225,507 | B2 | | 6/2007 | Anderson et al. |
| 2008/0276433 | A1 | | 11/2008 | Yacov |

* cited by examiner

*Primary Examiner* — Michelle Lopez

(57) ABSTRACT

An apparel fastener assembly includes an article of apparel that may be worn on a user. A gun may engage the article of apparel. A fastener cartridge is removably coupled to the gun. A lock cartridge is removably coupled to the gun. A plurality of fasteners is positioned within the fastener cartridge so the gun may selectively dispense one of the fasteners. A plurality of locks is positioned within the lock cartridge so the fastener may engage a selected one of the locks.

7 Claims, 3 Drawing Sheets

FIG. 3
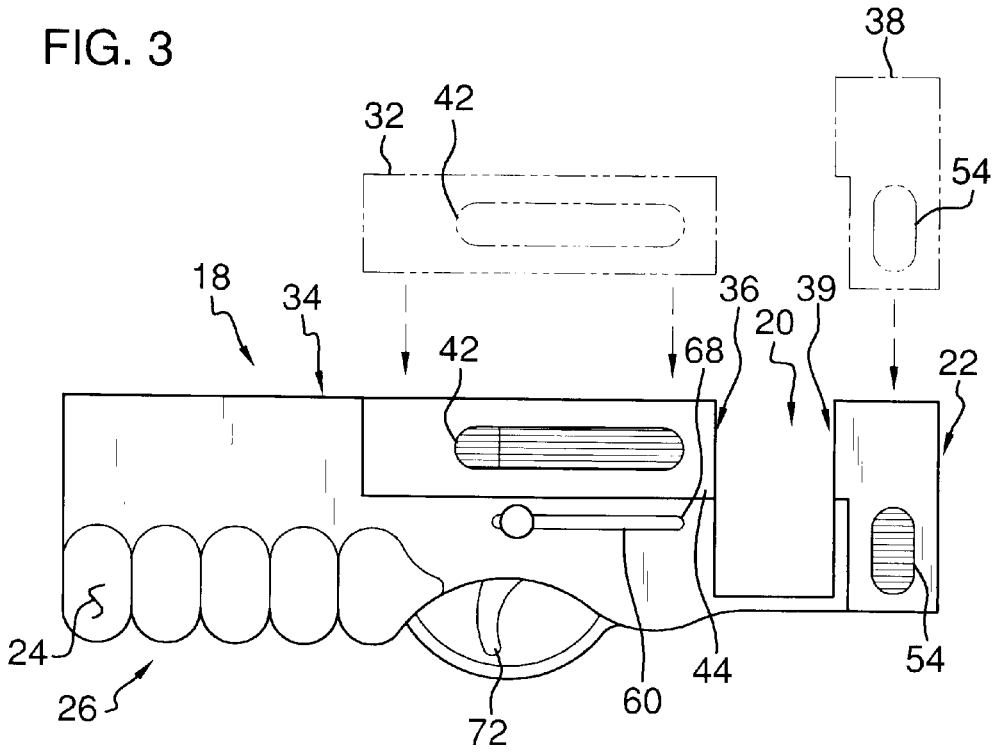
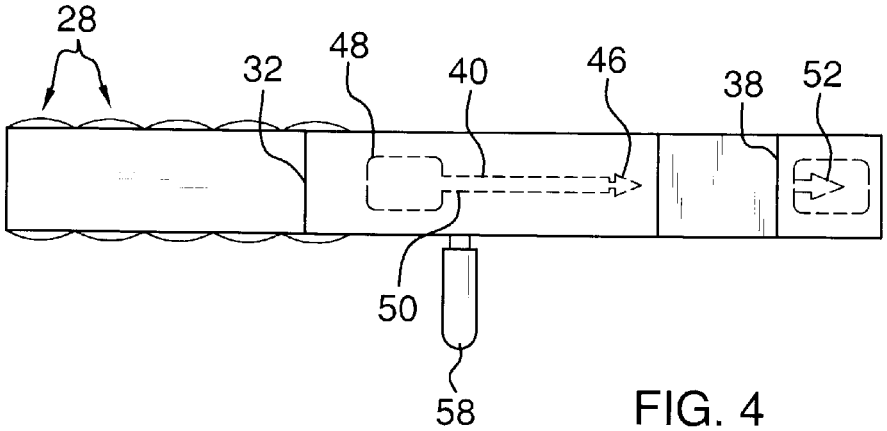
FIG. 4

APPAREL FASTENER ASSEMBLY

BACKGROUND OF THE DISCLOSURE

Field of the Disclosure

The disclosure relates to apparel fastener devices and more particularly pertains to a new apparel fastener device for fastening a pair of socks together.

SUMMARY OF THE DISCLOSURE

An embodiment of the disclosure meets the needs presented above by generally comprising an article of apparel that may be worn on a user. A gun may engage the article of apparel. A fastener cartridge is removably coupled to the gun. A lock cartridge is removably coupled to the gun. A plurality of fasteners is positioned within the fastener cartridge so the gun may selectively dispense one of the fasteners. A plurality of locks is positioned within the lock cartridge so the fastener may engage a selected one of the locks.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 3 is a right side view of an embodiment of the disclosure.

FIG. 4 is a top view of an embodiment of the disclosure.

DESCRIPTION OF THE PREFERRED EMBODIMENT

Figure 1:
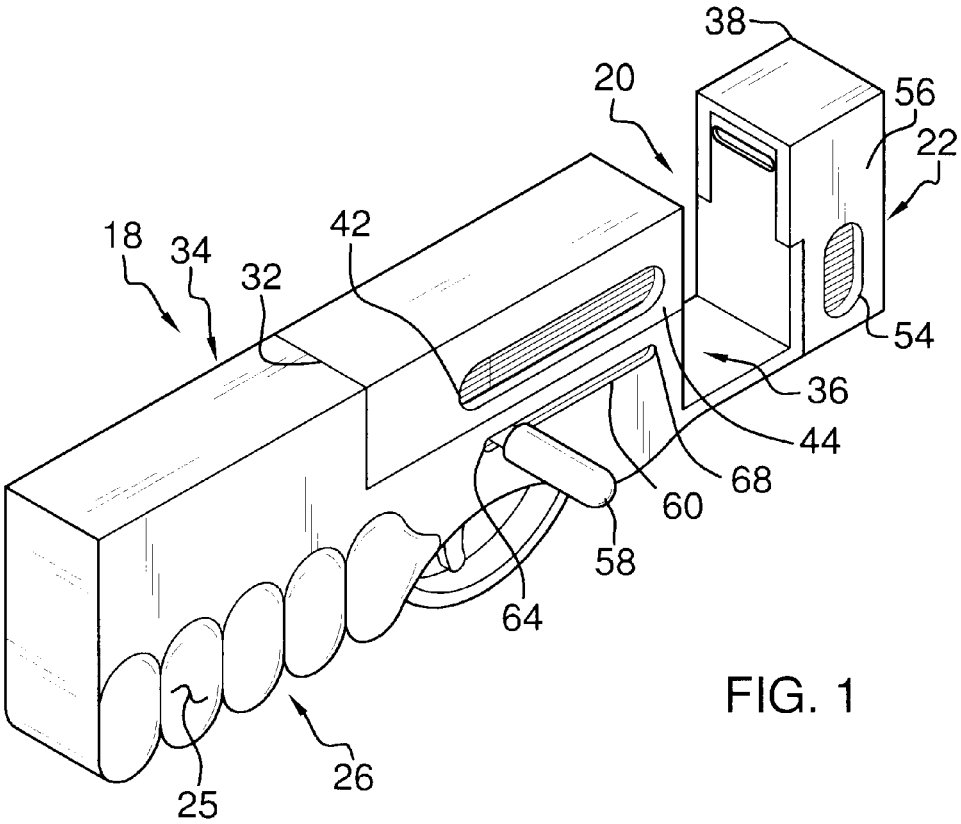
FIG. 1 is a perspective view of a apparel fastener assembly according to an embodiment of the disclosure.
Figure 2:
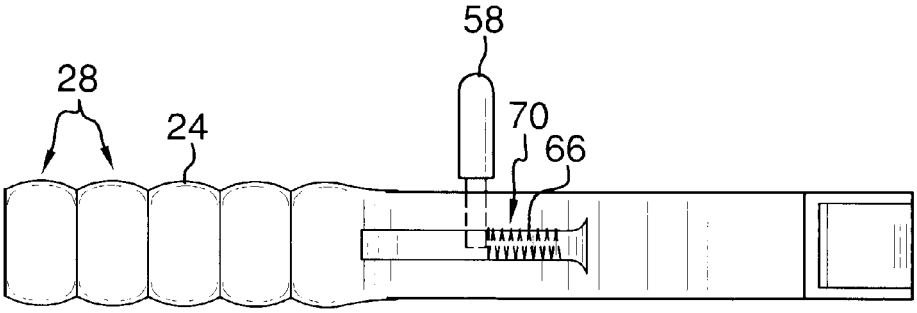
FIG. 2 is a bottom view of an embodiment of the disclosure.
Figure 5:
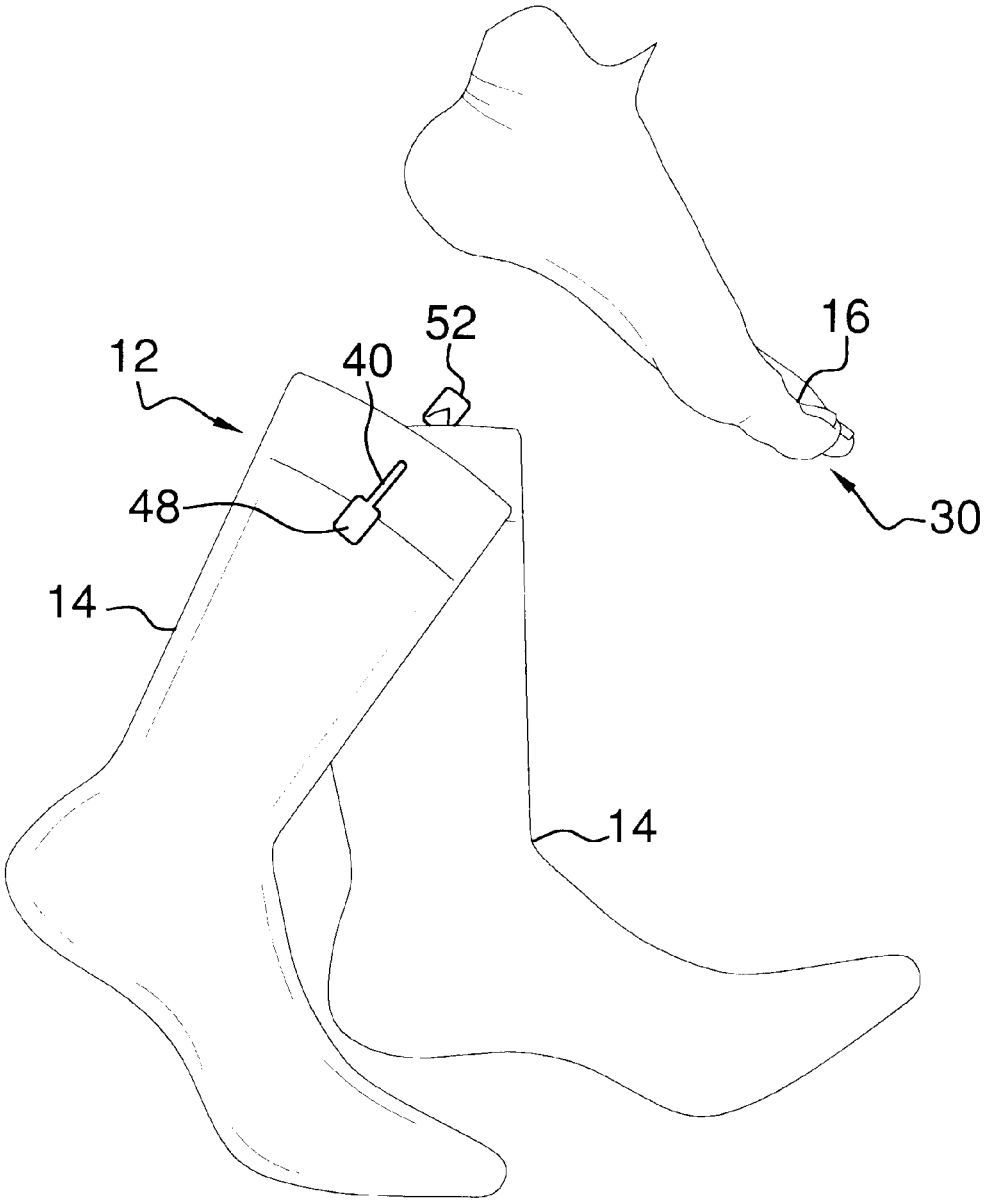
FIG. 5 is an in-use view of an embodiment of the disclosure.

With reference now to the drawings, and in particular to FIGS. 1 through 5 thereof, a new apparel fastener device embodying the principles and concepts of an embodiment of the disclosure and generally designated by the reference numeral 10 will be described.

As best illustrated in FIGS. 1 through 5, the apparel fastener assembly 10 generally comprises an article of apparel 12 comprising a sock 14 of any conventional design that may be worn on a user's foot 16. The sock 14 is one of a pair of socks 14. A gun 18 is provided that has a sock space 20 proximate a front 22 of the gun 18. The sock space 20 may insertably receive the pair of socks 14. An outside surface 24 of the gun 18 proximate a bottom 26 of the gun 18 may comprise a plurality of undulating curves 28. The undulating curves 28 may provide a grip for the user 30. The gun 18 may have a length between 12 cm and 18 cm.

A fastener cartridge 32 is removably coupled to a top 34 of the gun 18. The fastener cartridge 32 is positioned proximate a back 36 of the sock space 20. The fastener cartridge 32 may have a length between 5 cm and 8 cm. A lock cartridge 38 is removably coupled to the front 22 of the gun 18. The lock cartridge 38 is positioned proximate a front 39 of the sock space 20. The lock cartridge 38 may have a length between 2.5 cm and 5 cm.

A plurality of fasteners 40 is positioned within the fastener cartridge 32 so the gun 18 may selectively dispense one of the fasteners 40. The fasteners 40 are visible through an observation opening 42 extending through a first lateral wall 44 of the fastener cartridge 32. The fasteners 32 each have a conical front end 46. A tag 48 is coupled to a back end 50 of each of the fasteners 32. A plurality of locks 52 is positioned within the lock cartridge 38. The conical front end 46 of a selected one of the fasteners 32 may engage a selected one of the locks 52 so the fastener 32 is retained in the selected lock 52. The locks 52 are visible through an observation opening 54 extending through a first lateral wall 56 of the lock cartridge 38.

A lever 58 is movably coupled to the gun 18. The lever 58 extends outwardly from a lever opening 60 extending into a first lateral wall 62 of the gun 18. The lever 58 is positionable in a cocked position so the lever 58 is positioned proximate a back 64 of the lever opening 60. A biasing member 66 is coupled to the lever 58. The biasing member 66 biases the lever 58 toward a front 68 of the lever opening 60. The biasing member 66 may comprise a spring 70.

A trigger 72 is movably coupled to the bottom 26 of the gun 18. The trigger 72 is selectively actuatable by the user 30. The trigger 72 may engage the lever 58 after the lever 58 is positioned in the cocked position. The biasing member 66 may bias the lever 58 forwardly to engage a selected one of the fasteners 32 so the fastener 32 is urged forwardly across the sock space 20. The fastener 32 may extend through the pair of socks 14 positioned within the sock space 20 to engage a selected lock 52. The lock 52 and fastener 40 may couple the pair of socks 14 together to prevent the pair of socks 14 from being separated when the pair of socks 14 is washed.

In use, each of the fastener 32 and lock 38 cartridges may be coupled to the gun 18. The pair of socks 14 may be positioned in the sock space 20 on the gun 18. The user 30 may position the lever 58 in the cocked position and then pull the trigger 72. The lever 58 may push one of the fasteners 32 through the pair of socks 14 to engage one of the locks 52. The pair of socks 14 may be laundered after the pair of socks 14 is coupled together. After the pair of socks 14 is laundered, the fastener 32 may be removed from the lock 52 to separate the pair of socks 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An apparel fastener assembly comprising:

a gun configured to engage an article of apparel;

a fastener cartridge removably coupled to said gun, said gun comprising a sock space proximate a front of said gun wherein said sock space is configured to insertably receive a pair of socks;

a lock cartridge removably coupled to said gun;

a plurality of fasteners positioned within said fastener cartridge wherein said gun selectively dispenses one of said fasteners at a time;

a plurality of locks positioned within said lock cartridge wherein said fastener being dispensed engages a selected one of said locks;

a trigger movably coupled to a bottom of said gun;

a lever movably coupled to said gun; and said trigger being selectively actuatable by the user wherein said trigger engages said lever after said lever is positioned in a cocked position wherein said lever is urged forwardly to engage a selected one of said fasteners wherein said fastener is urged forwardly across said sock space.

2. The assembly according to claim 1, further comprising said fastener cartridge being removably coupled to a top of said gun wherein said fastener cartridge is positioned proximate a back of said sock space.

3. The assembly according to claim 1, further comprising said lock cartridge being removably coupled to a front of said gun wherein said lock cartridge is positioned proximate a front of said sock space.

4. The assembly according to claim 1, further comprising said lever extending outwardly from a lever opening extending into a first lateral wall of said gun.

5. The assembly according to claim 4, further comprising said lever being positionable in a cocked position wherein said lever is positioned proximate a back of said lever opening.

6. The assembly according to claim 1, further comprising said fastener extending through said sock space and engaging said lock wherein said fastener and said lock are configured to couple the pair of socks together.

7. An apparel fastener assembly comprising:

a gun having a sock space proximate a front of said gun wherein said sock space is configured for insertably receiving a pair of socks;

a fastener cartridge being removably coupled to a top of said gun wherein said fastener cartridge is positioned proximate a back of said sock space;

a lock cartridge being removably coupled to a front of said gun wherein said lock cartridge is positioned proximate a front of said sock space;

a plurality of fasteners positioned within said fastener cartridge wherein said gun selectively dispenses one of said fasteners at a time;

a plurality of lock positioned within said lock cartridge wherein said a selected one of said fasteners engages said lock;

a lever movably coupled to said gun wherein said lever extends outwardly from a lever opening extending into a first lateral wall of said gun, said lever being positionable in a cocked position wherein said lever is positioned proximate a back of said lever opening; and a trigger movably coupled to a bottom of said gun, said trigger being selectively actuatable by the user wherein said trigger engages said lever after said lever is positioned in said cocked position wherein said lever is urged forwardly to engage a selected one of said fasteners wherein said fastener is urged forwardly across said sock space such that said fastener is configured to extend through said pair of socks positioned within said sock space and engage said lock wherein said pair of socks is coupled together.

* * * * *